US006724134B1

(12) United States Patent
Schaefer

(10) Patent No.: US 6,724,134 B1
(45) Date of Patent: Apr. 20, 2004

(54) SURFACE DISCHARGE LAMP AND SYSTEM

(75) Inventor: Raymond B. Schaefer, Lexington, MA (US)

(73) Assignee: Phoenix Science and Technology, Inc., Chelmsford, MA (US)

( * ) Notice: Subject to any disclaimer, the term of this patent is extended or adjusted under 35 U.S.C. 154(b) by 84 days.

(21) Appl. No.: 10/106,336

(22) Filed: Mar. 26, 2002

(51) Int. Cl.[7] ..... H01J 1/88

(52) U.S. Cl. ..... 313/268; 315/112

(58) Field of Search ..... 313/231.31, 231.71, 313/586, 113, 587, 581, 570, 268, 353, 231.61; 315/335, 111, 112

(56) References Cited

U.S. PATENT DOCUMENTS

| | | | | | |
|---|---|---|---|---|---|
| 4,325,006 | A | * | 4/1982 | Morton | 315/112 |
| 4,877,997 | A | * | 10/1989 | Fein | 313/634 |
| 5,613,509 | A | * | 3/1997 | Kolb et al. | 134/56 R |
| 5,782,253 | A | * | 7/1998 | Cates et al. | 134/105 |
| 5,945,790 | A | | 8/1999 | Schaefer | |
| 6,229,272 | B1 | * | 5/2001 | Root | 315/335 |

OTHER PUBLICATIONS

S.I. Andreev et al., $CO_2$ Laser Initiated by a Gliding Discharge, P.N. Lebedev Physics Institute, USSR Academy of Science, ZhETF Pis. Red. 21, No. 7, 424–246; Apr. 5, 1975.
A.S. Bashkin et al., High–power 1 $\mu$sec Ultraviolet Source for Pumping of Gas Lasers, P.N. Lebedev Physics Institute, Academy of Sciences of the USSR, Moscow, 3, 1824–1826, Aug. 1976.
D. Yu. Zaroslov et al., Spectral Characteristics of Vacuum Ultraviolet Preionization Sources for $CO_2$ Lasers, P.N. Lebedev Physics Institute, Academy of Sciences of the USSR, Moscow, 5, 1221–1229, Jun. 1978 543–700.
D. Yu. Zaroslov et al., Use of a Surface Discharge for Preionization of Gases in Discharge Lasers, Academy of Sciences of the USSR, Moscow, 8, 1843–1847, Aug. 1978.
V. Yu. Baranov et al., Article from Academy of Sciences of the USSR, Moscow, 8, 77–82, Jan. 1981.
V.M. Borisov et al., Experimental Investigation of the Characteristics of a Planar Surface Discharge, Kvantovaya Elektron, Moscow, 9, 2159–2167, Nov. 1982.
V.M. Borisov et al., Hydrogen Fluoride Chemical Laser Initiated by a Discharge Creeping on the Surface of a Dielectric, Kvantovaya Elektron, Moscow, 10, 1065–1067, May 1983.

(List continued on next page.)

*Primary Examiner*—Nimeshkumar D. Patel
*Assistant Examiner*—Glenn Zimmerman
(74) *Attorney, Agent, or Firm*—Cesari and McKenna, LLP; Edwin H. Paul, Esq.

(57) ABSTRACT

A high intensity discharge lamp includes a dielectric substrate, a first electrode near the dielectric substrate, a second electrode spaced from the first electrode and near the dielectric substrate, with a discharge gas contained and enclosed by a shaped reflector and window. The reflector shapes are adapted to the particular process. The lamp to be used in volumetric chambers with high reflectivity walls and in arrangements of multiple lamps for high processing rates and long penetration lengths. Erosion of the dielectric is controlled by the use of high-pressure gases, and filtration and the use of electric fields reduce lamp contamination. The dielectric and electrodes are gas cooled on the outside and through the use of perforated electrodes. A small diameter tubular dielectric is used to increase light emission, improve re-imaging capability and increase the electrical impedance.

19 Claims, 5 Drawing Sheets

OTHER PUBLICATIONS

V.M. Borisov et al., Pulsed Periodic Surface Discharge, Kvantovaya Elektronika, Moscow, vol. 10, No. 10, Oct. 1983.

D. Yu. Zaroslov et al., A Moving Discharge in $CO_2$ and Excimer Lasers, Akademiya nauk SSSR. Radiotekhnika I elektronika, vol. 29, No. 7, pp. 1217–1241, 1984.

R.E. Beverly, III., Application of Surface Discharges for UV Photodissociation, Photoinitiation and Preionization of Gas–flow Lasers, Intl. Phys. Conf. Ser. No. 72, Presented at $5^{th}$ GCL Symp., Oxford, Aug. 20–24, 1984.

Rolf W. F. Gross et al., Investigation of the VUV Radiation Produced By a Sliding Discharge, Report of the Aerospace Corporation, Jun. 30, 1986.

V.M. Borisov et al., The Kilowatt Range High Repetition Rate Excimer Lasers, The Troitsk Kurchatov Research, Institute, Moscow, undated.

V.M. Borisov et al., Pulse–periodic 600–w XeCI Laser for Industrial Applications, I.V. Kurchatov Institute of Atomic Energy, Moscow, 18, Feb. 183–185, 1991.

* cited by examiner

SURFACE DISCHARGE LAMP AND SYSTEM

STATEMENT REGARDING FEDERALLY SPONSORED RESEARCH OR DEVELOPMENT

The present application was developed at least in part under the following government contracts: National Science Foundation contract number DMI-9760405; the Environmental Protection Agency contract number 68-D-00-257; and the U.S. Air force contract number F09650-98-M-1017. The United States Government may have rights in this application.

CROSS-REFERENCE TO RELATED APPLICATIONS

Not Applicable

BACKGROUND OF THE INVENTION

Field of the Invention

The present invention relates to an electromagnetic radiation lamp, specifically to a high intensity pulsed lamp in which light is generated by an electric discharge along or near the surface of a dielectric material.

Pulsed lamps are used in a wide variety of commercial, military, industrial, academic, medical and environmental applications, including treatment of contaminated water and industrial effluent, disinfection of water, materials and objects, laser excitation, paint stripping, curing, photography, decontamination, strobes, beacons, and the like. In commercial flashlammps stored electrical energy is deposited into a gas between two electrodes enclosed in a transparent envelope. The electrical discharge produces plasma that is a source of radiant energy with a spectrum that can range from the infrared, to the visible and ultraviolet regions of the spectrum. The envelope serves to confine the plasma generated by the electrical discharge. Electrical energy typically is delivered in a pulse to the flashlamp by a capacitor (or capacitors) that has been charged up by a high voltage power supply. The flashlamp is repetitively pulsed to provide throughput for commercial use. Thus the optical pulses from the flashlamp characteristically have a high peak power in a system with a relatively low average power.

The intensity from flashlamps is limited by its envelope, which explodes if the pressure and impulse from the pulsed electrical discharge is too large. Also, the lifetime of the flashlamp depends strongly on its operating level relative to its explosion limit. In many uses it would be advantageous to operate at intensities that are impractical with flashlamps.

The Surface Discharge (SD) is a pulsed lamp that is known in the art but has seen little commercialization. The SD lamp has many of the same generic characteristics described above for flashlamps but circumvents some of the limitations. In an SD lamp the pulsed electrical discharge is along the surface of a dielectric. One such known invention is found in my U.S. Pat. No. 5,945,790, which patent is hereby incorporated herein by reference. The present invention can be used in conjunction with that patent and other known SD sources.

In many commercial applications, SD lamps generate very high intensity light pulses. This is feasible because the light emitting plasma is generated along the surface of the dielectric, so that an envelope is not required to confine the plasma. The pressure pulse generated by the high intensity discharge plasma is unconfined, and decreases as the plasma expands. In SD lamps with a dielectric tube known in the art, the SD lamp has an outer tube with a large enough diameter that by the time the pressure pulse reaches the wall it has decreased below levels of concern for degradation. This implementation is found in applications in which the lamp is immersed in a medium, as in UV, ultra violet, water treatment. However, large diameter high quality fused silica tubes are expensive, the end pieces and seals are practical issues.

In addition, many applications utilize light deposited into a volume for any of a number of processing objectives. It is an object of the present invention to employ processing geometries in conjunction with one or more SD lamps in ways that efficiently utilizes the light output, and, when required, that increases the penetration depth of the light into the volume.

Also, for certain combinations of high intensity and pulse length, material is evaporated from the dielectric. The evaporated material evolves into the light emitting plasma, and may contribute to the spectral output It is an object of the present invention to utilize specific dielectric materials to increase the light output in specific spectral ranges. Also, the evaporation of dielectric material may reduce SD lamp lifetime. It is another object of the present invention to reduce the erosion rate in order to increase lifetime.

In flashlamps known-in-the-art, contaminants are produced by the pulsed electrical discharge which can reduce the useful life of the lamp. It is yet another object of the present invention to reduce contamination in order increase lamp lifetime.

Furthermore, high average power is desirable for many commercial uses, which cause heating that must be controlled. Prior art discloses means for cooling the dielectric from "inside," which increases cooling capability. Nevertheless, it is an object of the present invention to provide supplemental or alternative means of cooling.

Also, the dielectric in tubular surface discharges blocks a portion of the light emitted by the plasma. It is another object of the present invention to reduce fraction of light emitted by the plasma that impinges on the dielectric.

Accordingly, the present invention provides alternative means to operate SD lamps at very high intensity, to reduce the erosion rate of the dielectric, to provide new means for cooling, and to reduce light blockage by the dielectric.

SUMMARY OF THE INVENTION

In view of the foregoing background discussion, the present invention provides advantages for SD lamps and lamp systems that may be used separately or in conjunction, depending on the application.

In the present SD invention a light emitting plasma is generated along the surface of the dielectric, so that an envelope is not needed for confining the plasma. The means for enclosing the discharge gas is located well away from the discharge, so that the SD lamp can operate at much higher intensity than flashlamps.

The present invention provides an envelope for a surface discharge that is a combination of a reflector and window. The reflector provides directionality for the light, and may be of any number of shapes, depending on the application. An advantage of the combined reflector and window is that it is less expensive and more practical for many applications.

The present invention also provides reflector-window SD lamps in which the reflector has various shapes, e.g. an elliptical shape when high intensity is needed at a surface, for instance to strip paint, treat coatings and the like. Alternatively, the reflector may have a parabolic shape when uniform intensity is needed or a volume is to be irradiated, for instance to treat water.

The present invention includes using SD lamps with a processing chamber having high reflectivity walls and arranging multiple SD lamps to increase light use efficiency and the penetration depth.

The invention also provides means for reducing the erosion or ablation of the dielectric by employing a high-pressure gas adjacent to the dielectric to promote the recondensation of evaporated material back onto the solid dielectric. In addition, the present invention provides means for reducing gas contamination.

The present invention also provides means for cooling the dielectric material. Gas in the vicinity of the light emitting discharge flows along the surface of the dielectric removing heat from the region. Additionally, perforations or holes in the electrodes can provide a means for the gas to cool hot regions underneath the tips of the electrodes. Also in a preferred embodiment enclosed channels or pathways are formed to carry cooling water to the dielectric.

Also, according to the present invention, a small diameter dielectric tube, such as an optical fiber, may be used. An advantage of this embodiment it that a higher fraction of light emitted from the SD plasma leaves the lamp.

It will be appreciated by those skilled in the art that although the following Detailed Description will proceed with reference being made to illustrative embodiments, the drawings, and methods of use, the present invention is not intended to be limited to these embodiments and methods of use. Rather, the present invention is of broad scope and is intended to be defined as only set forth in the accompanying claims.

BRIEF DESCRIPTION OF THE DRAWINGS

The invention description below refers to the accompanying drawings, of which.

DETAILED DESCRIPTION OF PREFERRED EMBODIMENTS

In a surface discharge (SD) lamp, a plasma discharge is created by applying an electric potential that has sufficient magnitude to cause electronic breakdown of a discharge gas between two spaced apart electrodes near a dielectric surface. The return current returns underneath or inside the dielectric material. The resulting electronic discharge creates plasma streamers that emit intense incoherent light.

The present invention provides for an alternative means for containing the gas that employs a reflector and window combination to replace the large diameter envelope. This approach eliminates the need for a large diameter tube in applications where a reflector is required anyway, as in surface treatment. This eliminates both the cost of the envelope and the light losses from envelope absorption and reflections. The reflector-window concept may also be less expensive and more straightforward to implement. Even in applications where UV lamps currently are immersed in water, it may prove advantageous to irradiate water through a wall in a processing chamber. In UV water treatment, cleaning UV mercury lamps while immersed in water is a safety issue. Reflector-window SD lamps on the sides of a process chamber are easier to clean.

Figure 1:
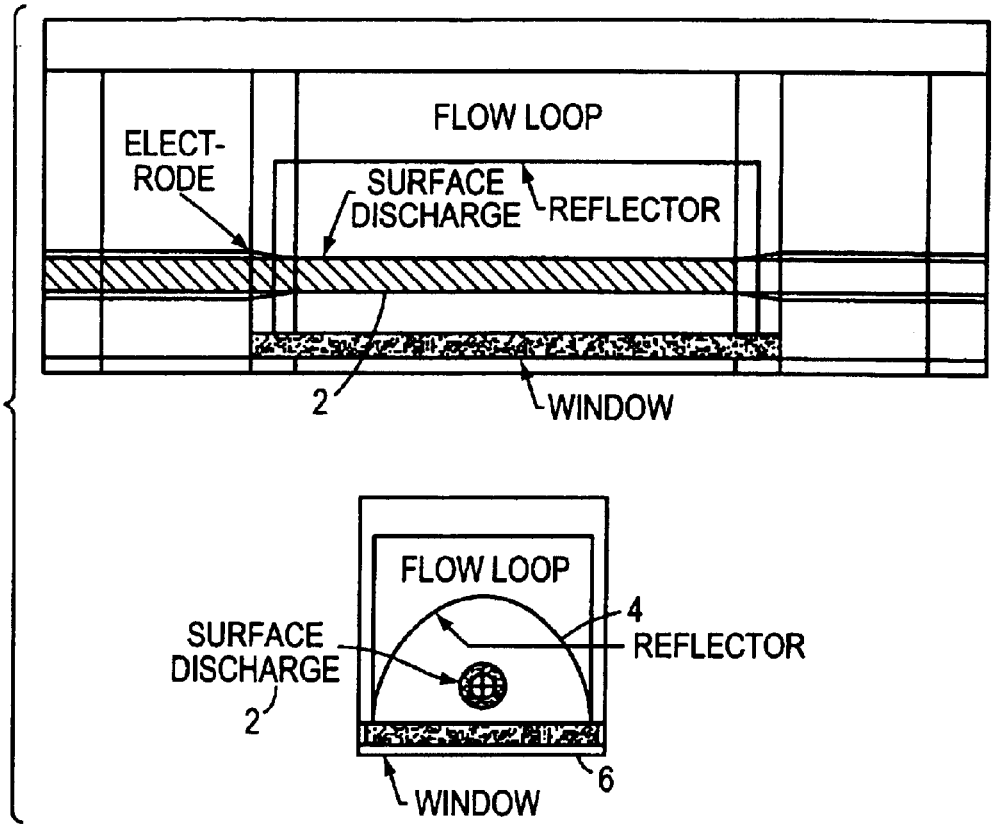
FIG. 1 is a side and front view of an example SD lamp employing a reflector and window.

A variety of arrangements employing reflectors and windows to contain the discharge gas and transfer light from the lamp system are understood to be within the scope of the invention, but a particularly advantageous arrangement is illustrated in FIG. 1. A tubular SD lamp 2 is located longitudinally in a reflector trough 4. In this embodiment the dielectric tube is centered on the focus of the reflector. The shape of the reflector would be elliptical for applications that reimage the SD for maximum intensity, or might be parabolic for applications requiring more uniform illumination in a volume or on a surface area. In general the reflector may have any shape (e.g. triangular, rectangular, etc.) depending on the application.

Figure 2A:
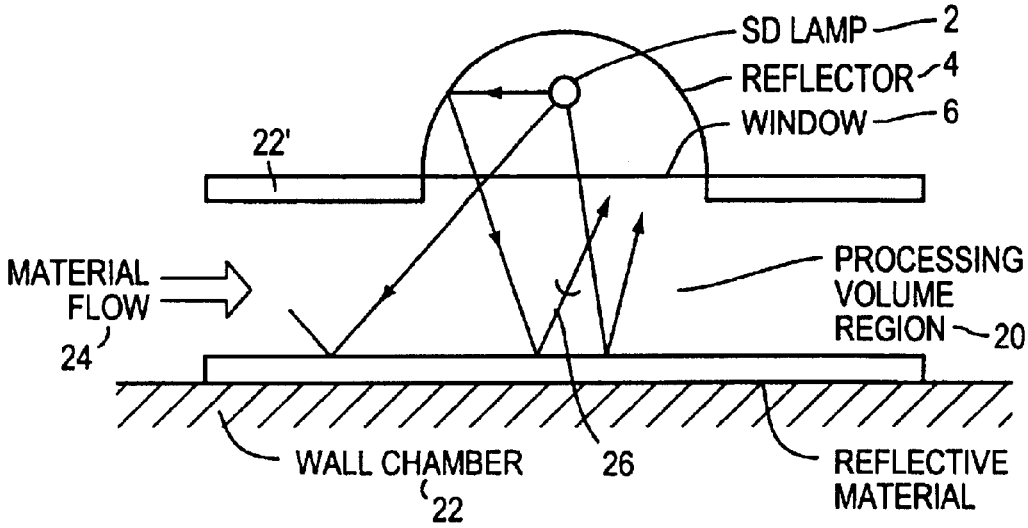
FIG. 2A is a cross section view of an SD lamp and processing chamber.
Figure 2B:
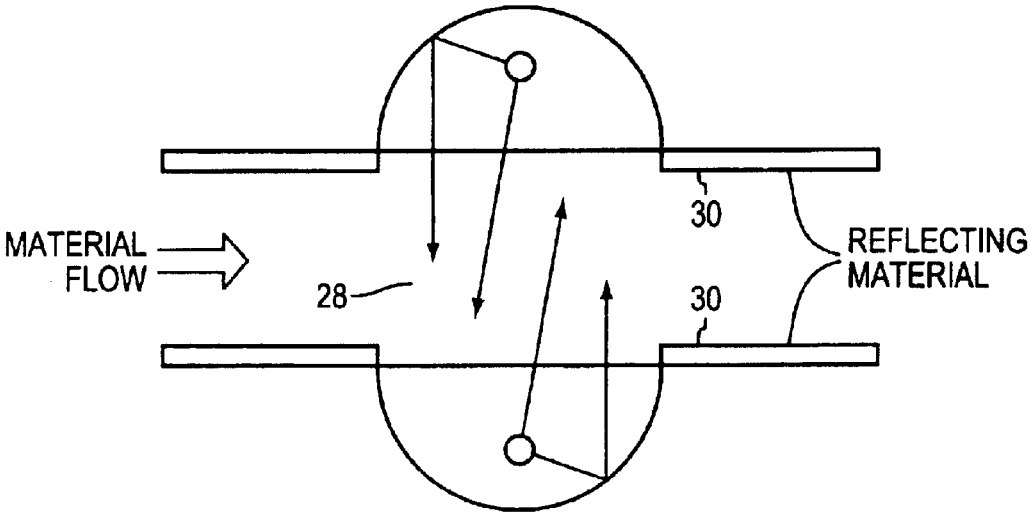
FIG. 2B is a cross section view of opposing SD lamps.

In one preferred embodiment, shown in FIG. 2A, the processing volume 20 is defined by the chamber wall(s) 22 and 22.' Material to be processed flows 24 through this irradiated volume. The wall 22 has a material that is highly reflective in the wavelength range of interest, so that useful light that is emitted via the window 6 reaches the wall and is reflected 26 back into the volume. The reflector material may be a standard reflector material, e.g. polytetrafluroethylene with or without known coatings. Also, materials such as Teflon® may be particularly advantageous for UV applications, and where inert materials are preferable. Where a long penetration depth is desired, SD lamps may be arranged opposite one another, shown in FIG. 2B. Light that penetrates to the opposite lamp is partially used by reflections back into the processing volume 28 and re-absorption into the light emitting plasma. In some preferred embodiments the walls 30 are lined with material reflective to useful UV light. Preferred embodiments of the present invention include various arrangements of multiple SD lamps, such as multiple lamps along the outside radius of a large pipe or side-by-side lamps along the sides of a rectangular chamber.

Figure 3:
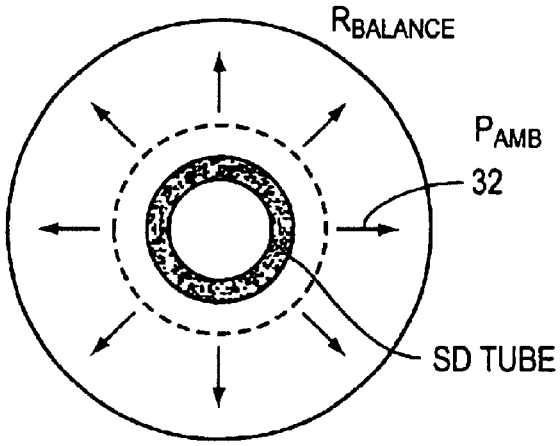
FIG. 3 is a cross section of an SD lamp.

The invention also provides means to reduce the erosion of the dielectric substrate that may result from high intensity electrical discharges. Depending on the materials used, discharges with power densities in the range of about 400 KW per cubic centimeter will usually exhibit dielectric substrate erosion. Hot vapor and dust may be generated from high intensity electrical discharges. With reference to FIG. 3, the pulsed discharge generates a pressure pulse that may cause the vapor and dust to move away 32 from the dielectric substrate. In flashlamps known in the art, the static gas pressure is typically less than one atmosphere. In this preferred embodiment erosion is reduced by employing a high ambient gas pressure in the lamp that limits movement of vapor and dust. The high pressure causes the hot dust and vapor and to resettle and possibly re-condense on the dielectric thereby reducing erosion. The required pressure depends on the gas type and electric discharge parameters, but may range from less than two to more than eight atmospheres for rare or other inert gases.

Despite the control afforded by the high-pressure gas environment, a residual vapor might not re-condense. Also, pulsed electric discharges may produce other contaminants that over time degrade lamp performance. Contaminants in general may collect on the output window and reflector and, over many pulses, reduce the light leaving the lamp. The invention includes several means for reducing contaminants. In one embodiment, exhibited in FIG. 4A, the ambient gas flows 40 out of the lamp, is filtered by any of several conventional filtration techniques 42 known-in-the-art, and is returned 44 to the lamp for reuse. Alternatively, because many contaminants have an electric charge, an electric field precipitator may be used as a filter. In one embodiment, with reference to FIG. 4B, the ambient gas flows out of the lamp and into a static electric field that might be generated by any of the methods of electrostatic precipitation known in the art. In another arrangement, an electric field 46 is generated from inside the dielectric (for instance, by electrocet materials known in the art) so as to produce an attractive force on charged vapor, silicon particles, electrode contaminants and the like.

Figure 4A:
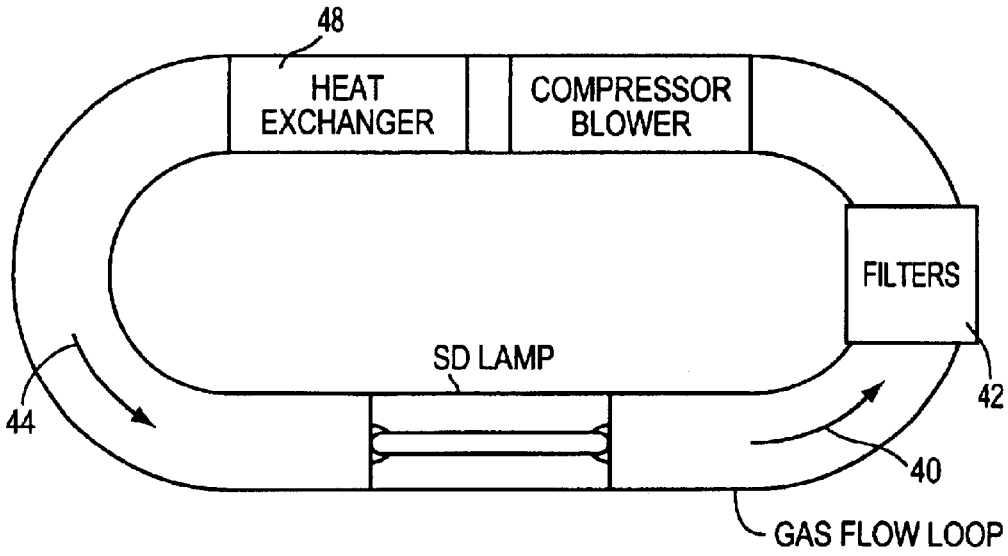
FIG. 4A is a schematic diagram of an SD lamp with circulating gas.
Figure 4B:
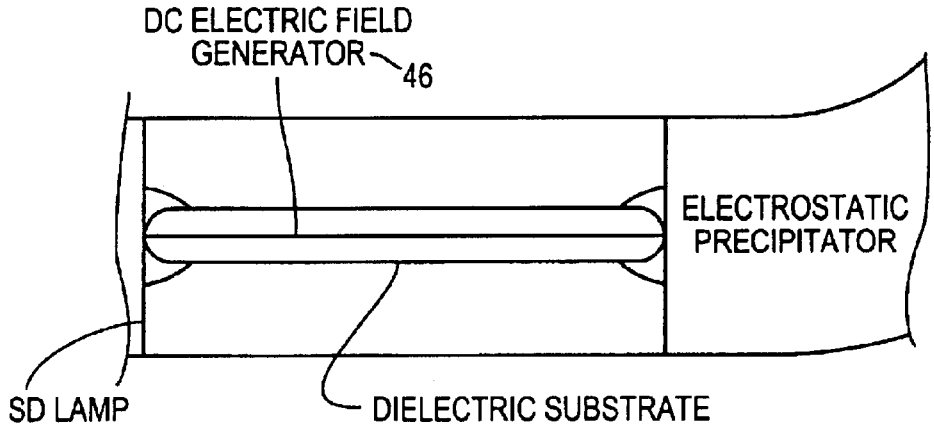
FIG. 4B is a cross section of an electrostatic precipitator type filter.
Figure 5:
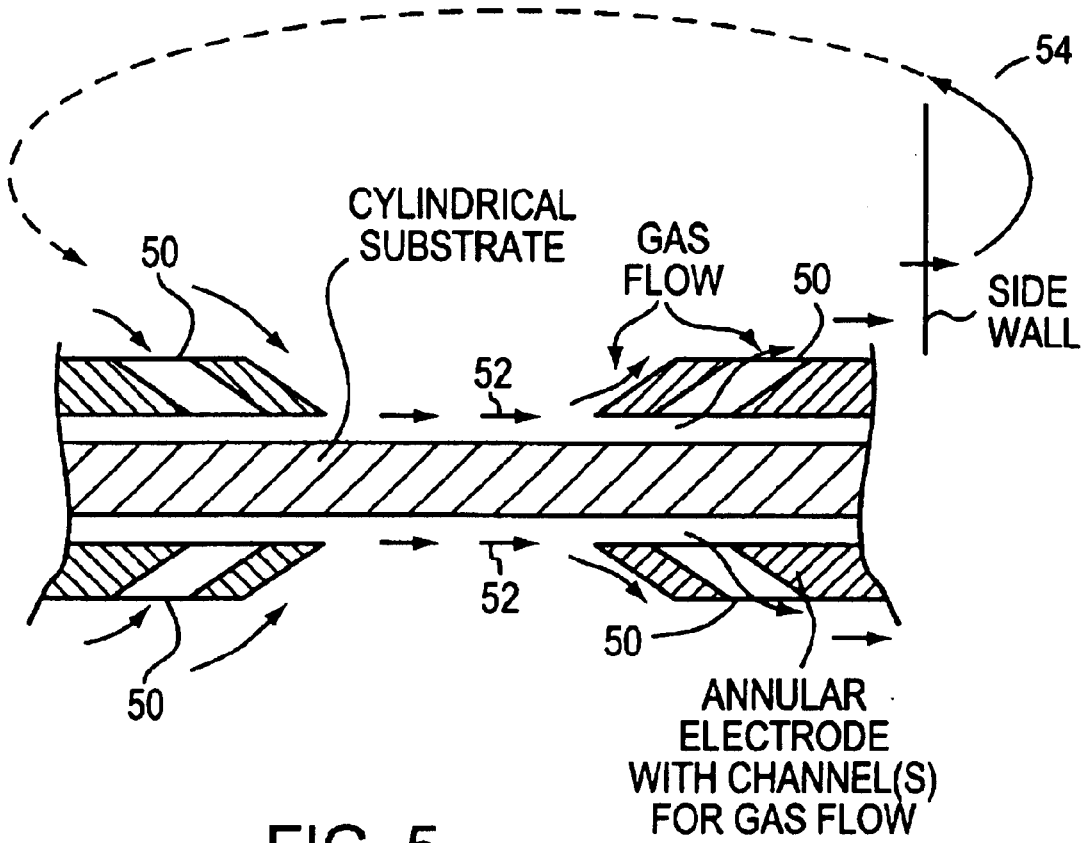
FIG. 5 is a cross section view of a cooling gas path.

The SD lamp will be repetitively pulsed at rates for commercial processes that require the SD lamp to be cooled. Prior art discloses a means for cooling the dielectric from the inside. The present invention-provides a means to cool the dielectric from the outside of the tube. In another preferred embodiment hot electrodes are cooled from beneath. In these embodiments, the gas on the discharge side of the dielectric flows along the dielectric, and possibly through the electrodes, to remove heat generated by the discharge. In FIG. 4A, the gas, after flowing along the dielectric, leaves the lamp and is cooled by any of the many heat exchanger 48 and gas flow systems known-in-the art. Referring now to FIG. 5, one embodiment has cooling channels 50 in the tip of each electrode, allowing gas or water to move through the channels both by gas or water flowing 52 from left to right in FIG. 5, as well as from the action of the pulsed electrical discharge. The flowing gas or water removes heat from both the electrodes and the dielectric substrate. In FIG. 5 the gas or water flows through a sidewall for recirculation 54 using any standard methods known in the art.

These arrangements are easily constructed and provide efficient cooling that increases the maximum power that a SD lamp can operate at continuously. This invention is intended to include applying the inventive cooling process to all standard SD geometries known in the art, in addition to geometries of the present invention.

Figure 6A:
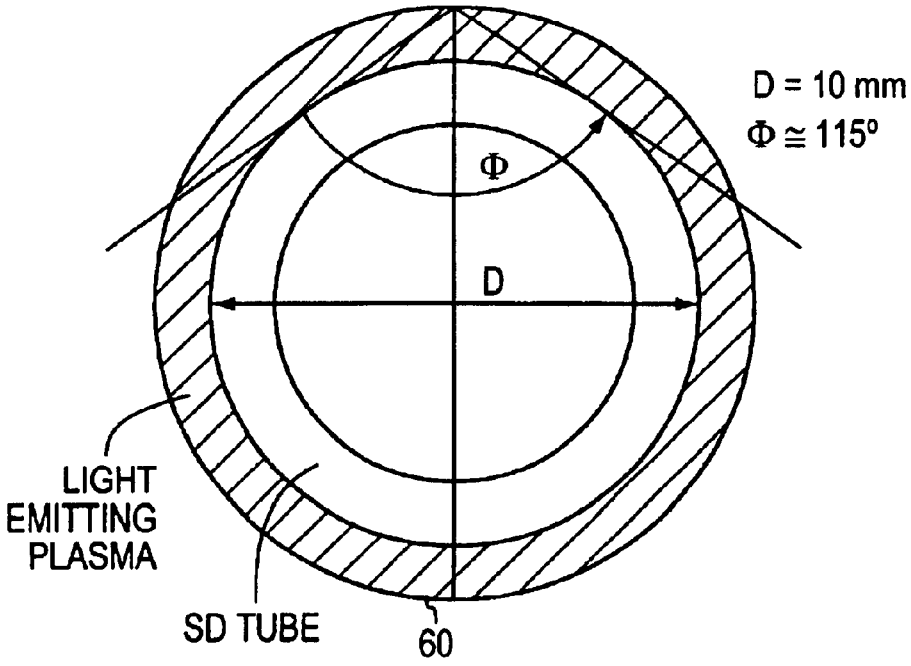
FIG. 6A (PRIOR ART)
FIGS. 6A and 6B are diagrams of reflective differences in larger/small diameter SD tubes.

Also, in SD's a portion of the light emitted by the plasma impinges on the dielectric substrate, which reduces the fraction of light that leaves the lamp. Referencing FIG. 6A, for SD's known-in-the-art, the diameters D of the dielectric tube range up from about 9 mm. Furthermore, for many SD's the light emitting plasma is compressed against the dielectric in a thin sheet 60, which may have a thickness of about 1 mm. Since light is emitted from the plasma in all directions, this results in a significant fraction of light impinging on the dielectric, as shown in FIG. 6A, where the intersection angle $\Phi$ for light from the edges of the plasma is about 115°. In addition, for some SD lamps, the impedance of the plasma is too small to efficiently transfer electrical energy into the plasma.

Figure 6B:
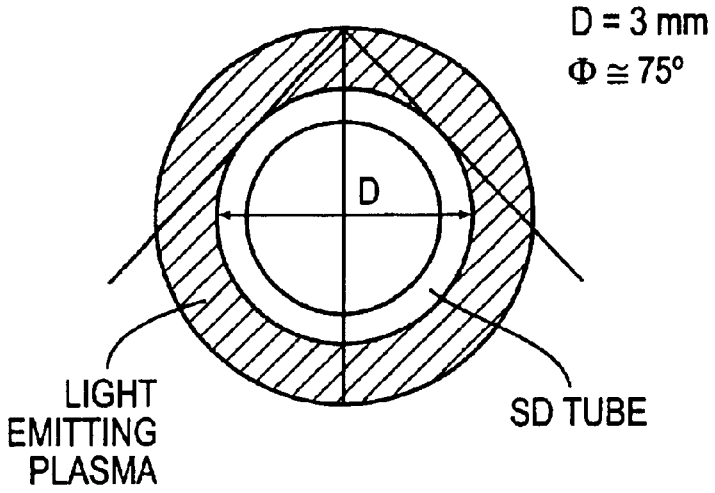

The present invention reduces the fraction of light impinging on the dielectric by employing small diameter D dielectric tubes of about 3 mm or optical fibers, such as shown in FIG. 6B. In the embodiment shown in FIG. 6B, the intersection angle for light from the edges of the plasma is about 75° and the light impinging on the dielectric substrate is reduced by about one-third from that in FIG. 6A.

Furthermore, in situations in which it is desirable to re-image SD light at high intensity (e.g. for paint stripping), the larger the diameter of the light-emitting plasma, the lower the efficiency of re-imaging the light. This is because the light leaves the plasma on the outside of the dielectric away from the focus at the center. The present invention provides a small diameter dielectric tube of about 3 mm diameter that moves the light emitting plasma closer to the focus of the reflector, as illustrated in FIG. 1 and thus improves the efficiency of re-imaging the light.

In addition, the electrical impedance of some high intensity SD's is so low that efficient transfer of electrical energy to the lamp is impractical. This results in a "ringing" electrical circuit that, in addition relatively low efficiency, increases heating and reduces the lifetime of electrical components. Reducing the diameter of the plasma also increases the impedance of the lamp, which in turn improves the electrical transfer efficiency, reduces ringing and heating and increases the lifetime of electrical components. Thus the embodiment shown in FIG. 6B reduces light impinging on the dielectric, improves reimaging efficiency and increases electrical impedance.

It should be understood that above-described embodiments are being presented herein as examples and that many variations and alternatives thereof are possible. Accordingly, the present invention should be viewed broadly as being defined only as set forth in the hereinafter appended claims.

What is claimed is:

1. A surface discharge lamp system comprising:

a dielectric defining a surface supporting an electric discharge, a first and a second electrode spaced from each other and defining proximate tips of the first and the second electrodes, both the first and second electrodes placed near the dielectric surface, the electric discharge occurring along the surface of the dielectric between the proximate tips of the first and the second electrodes, with an electrical current return underneath or inside the dielectric, a surface surrounding the dielectric, the surface having a means for transmitting light there through, and an inert gas filling the space between the dielectric and the surface, wherein the inert gas is at a positive pressure of more than one atmosphere.

2. The surface discharge lamp system as defined in claim 1 wherein the positive pressure of the inert gas is selected to control the dielectric erosion.

3. A surface discharge lamp system comprising:

a dielectric defining a surface supporting an electric discharge, a first and a second electrode spaced from each other and defining proximate tips of the first and the second electrodes, both the first and second electrodes placed near the dielectric surface, the electric discharge occurring along the surface of the dielectric between the proximate tips of the first and the second electrodes, with an electrical current return underneath or inside the dielectric a reflective surface surrounding the dielectric, the reflective surface with an opening, an inert gas filling the space between the dielectric and the surface, wherein the inert gas is at a positive pressure of more than one atmosphere, and a window constructed to close the opening, wherein the dielectric is enclosed in a volume, wherein the reflective surface is arranged and constructed to direct light out through the window.

4. The lamp system as defined in claim 3 wherein the dielectric is elongated along an axis, and the reflective surface is elongated parallel to the axis, and wherein the reflective surface is shaped to distribute the light through the window in a specific distribution.

5. The lamp system as defined in claim 4 wherein the shape of the reflective surface is parabolic that distributes the light uniformly, or the shape of the reflective surface is elliptical that distributes the light in a focused high intensity beam.

6. The lamp system as defined in claim 4 wherein the elongated dielectric is a small diameter tube or an optical fiber.

7. A surface discharge lamp system as defined in claims 1, 2, 3, 4, 5, or 6, further comprising a chamber arranged to receive the light emanating from the discharge.

8. The lamp system as defined in claim 7 wherein the interior walls of the chamber are constructed with reflective interior walls that receive and reflect light incident upon the walls of the chamber.

9. The lamp system as defined in claim 8 wherein the walls reflect spectral regions of light.

10. The lamp system as defined in claim 9 wherein the spectral region is the ultra violet region.

11. The lamp system as defined in claim 8 wherein the material for the reflective walls is polytetrafluroethylene.

12. A surface discharge lamp system comprising:

at least two lamp systems as defined in claims 1, 2, 3, 4, 5 or 6, a chamber arranged and constructed to receive light from the at least two lamp systems.

13. A surface discharge lamp as defined in claims 1, 2, 3, 4, 5, or 6 further comprising:

channels constructed interior to the proximate ends of the electrodes, means for flowing water through the channels, and means for removing the water from the channels.

14. A surface discharge lamp system as defined in claims 1, 2, 3, 4, 5, or 6 further comprising means for generating a direct current electric field proximate to the dielectric material wherein the direct current electric field controls the erosion of the dielectric material.

15. The lamp systems as defined as defined in claims 3, 4, 5, or 6 further comprising a gas filling the volume between the dielectric and the reflective surface and the window, wherein the gas is at a positive pressure of more than one atmosphere for controlling erosion of the dielectric.

16. A surface discharge lamp as defined in claim 15 further comprising means for filtering the gas.

17. A surface discharge lamp system as defined in claim 16 wherein the means for filtering comprises an electrostatic precipitator filter.

18. The surface discharge lamp system as defined in claim 15 further comprising means for cooling the gas, and means for directing the cooled gas to the electrode tips and the dielectric surface.

19. The surface discharge lamp system as defined in claim 18 further comprising:

channels constructed in the proximate ends of the electrodes, and means for directing the cooled gas through the channels and along the dielectric surface.

* * * * *